United States Patent [19]

Kettlestrings

[11] 4,170,215

[45] Oct. 9, 1979

[54] DISK TOY AND LAUNCHER

[76] Inventor: John S. Kettlestrings, 299 Carleton Dr., Carol Stream, Ill. 60187

[21] Appl. No.: 867,571

[22] Filed: Jan. 6, 1978

[51] Int. Cl.[2] ..... F41B 3/04

[52] U.S. Cl. ..... 124/16; 124/42; 124/31; 124/7

[58] Field of Search ..... 124/16, 36, 41 R, 42, 124/43, 7; 273/26 D, 106 B; 46/74 D, 82, 74 R, 84

[56] References Cited

U.S. PATENT DOCUMENTS

| | | | |
|---|---|---|---|
| 1,468,004 | 9/1923 | Cavicchioli | 124/42 X |
| 2,598,354 | 5/1952 | Clauss | 124/42 X |
| 3,487,824 | 1/1970 | Profitt | 124/42 X |
| 3,959,915 | 6/1976 | Kettlestrings | 46/74 D |
| 4,016,854 | 4/1977 | Lehman | 46/74 D X |

*Primary Examiner*—Richard C. Pinkham
*Assistant Examiner*—William R. Browne
*Attorney, Agent, or Firm*—Hill, Van Santen, Steadman, Chiara & Simpson

[57] ABSTRACT

An inexpensive mechanical launcher for launching certain toy disks consists of two predominantly planar pieces of pre-formed plastic material joined together forming a slotted receptor and a handle portion. A toy disk is inserted in the slotted receptor and engages a catch with its outside rim. A spring for biasing the disk against the catch is preloaded during insertion and is engaged with a notch on the disk rim. A plunger having a manually engageable trigger retracts the catch and allows the spring to return to its released position, thus flinging the disk in an outwardly spinning trajectory which can be influenced and altered by varying the axial position of the launcher before release.

13 Claims, 11 Drawing Figures

Fig. 1
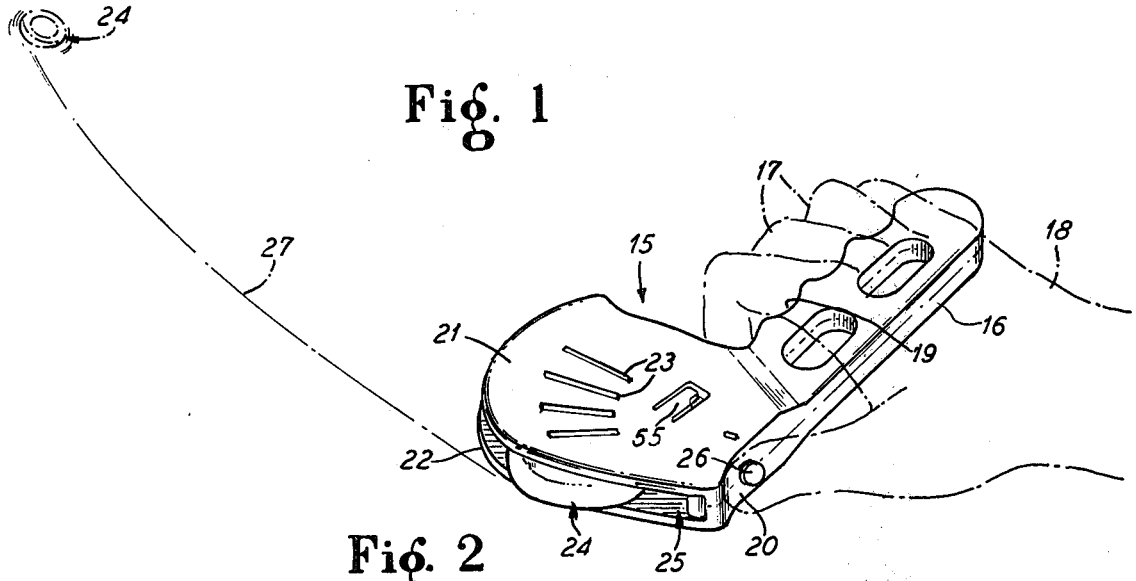
Fig. 2
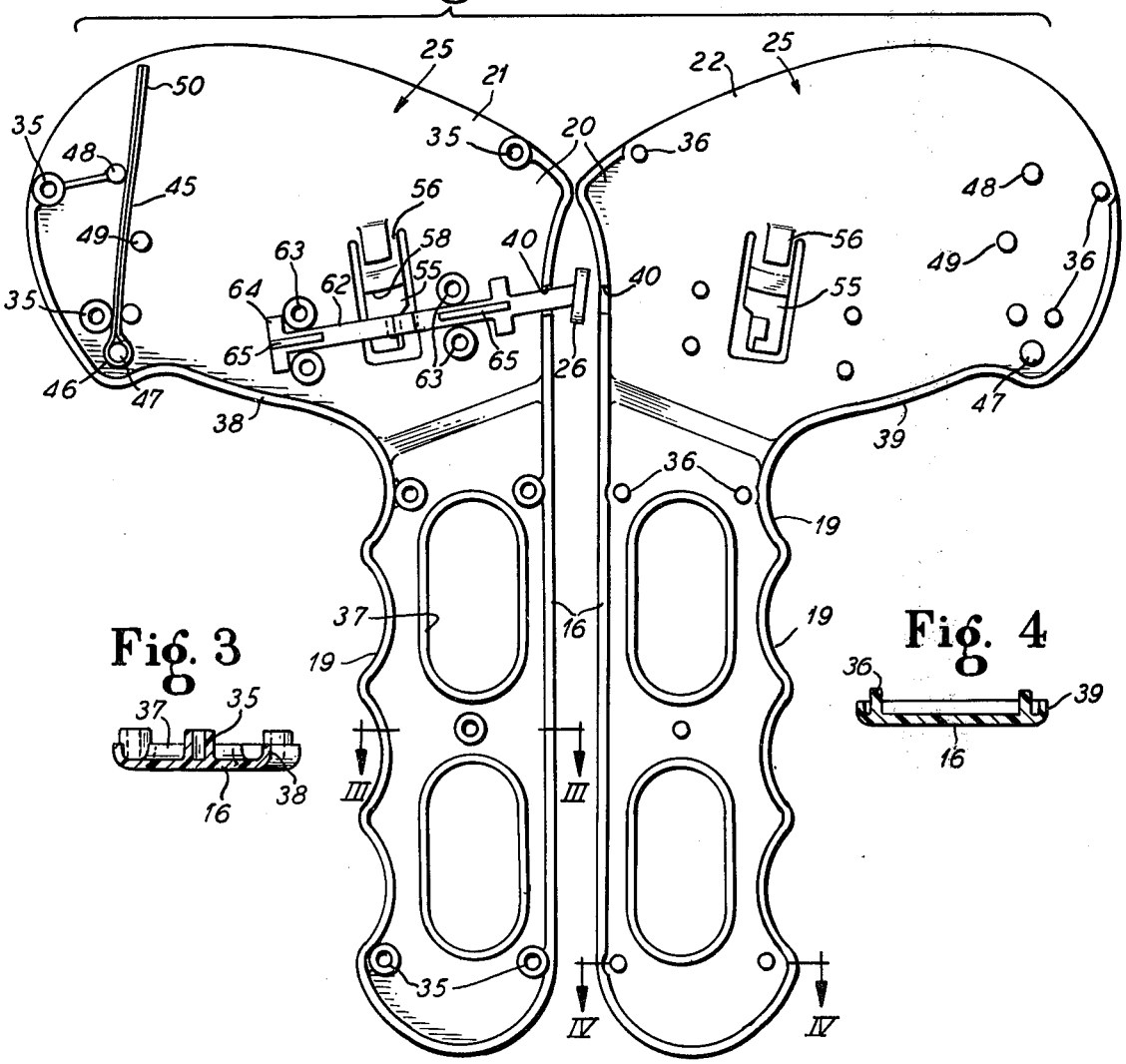
Fig. 3
Fig. 4

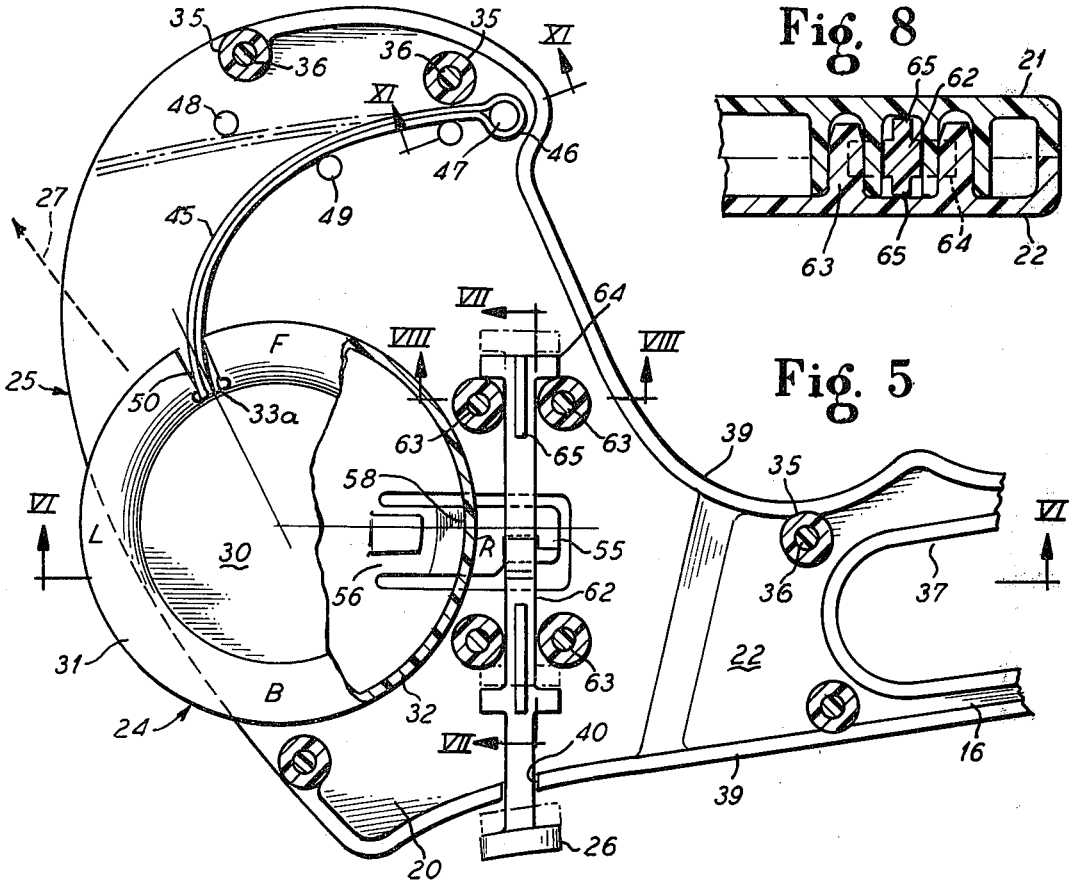
Fig. 5
Fig. 8
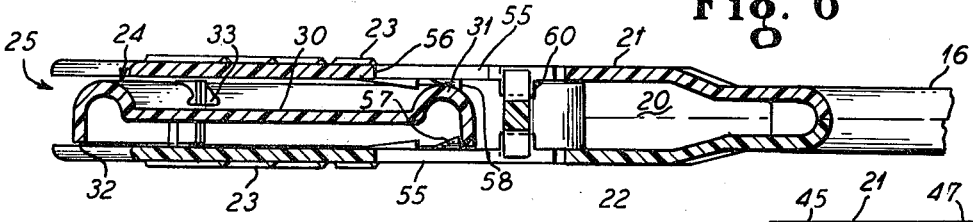
Fig. 6
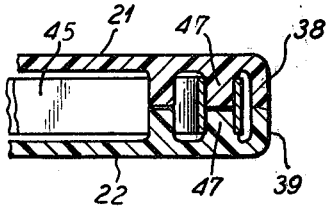
Fig. 9
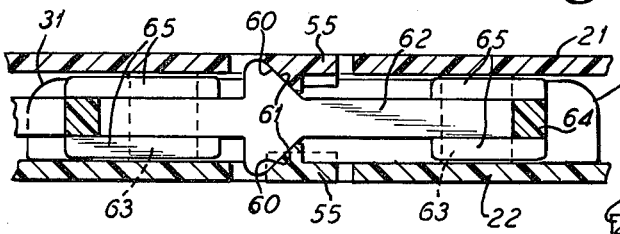
Fig. 7
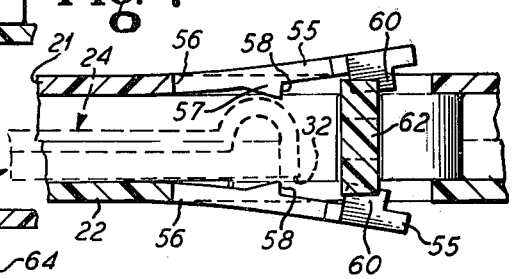
Fig. 11
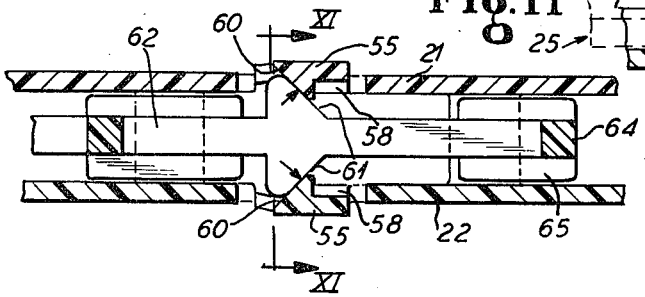
Fig. 10

DISK TOY AND LAUNCHER

BACKGROUND OF THE INVENTION

1. Field of the Invention

The present invention relates to devices for amusement and self-entertainment, including devices for launching projectiles with predetermined motions.

2. The Prior Art

The use of aerodynamic circular disks has been popularized by the "Frisbee". The "Frisbee" has required the user to propel and spin the disk by a skillfull throwing action by a user. The "Frisbee" has developed into a highly sophisticated aerodynamic device; an entire sport has evolved about such disks.

My U.S. Pat. No. 3,959,915 discloses a resilient, elastic impeller for spinning and propelling a circular aerodynamic disk. The impeller, held in one hand, is engaged in a slot in the periphery of the disk, securing the disk and impeller together as the impeller is flexed by application of an opposing force to the disk by the user's other hand. When the disk is released, the disk is spun and propelled by deflexing of the impeller. Such prior invention requires that the user exercise only a minimum amount of skill and dexterity, affording more persons the enjoyment of play involved with a conventional "Frisbee". For instance, even young children can derive satisfaction from the use of such prior invention.

Other launchers are known generally each of which has a spring released by a trigger mechanism to send a projectile along a trajectory with a translational motion. No such launcher is known which is adapted for lauching an aerodynamic disk with spinning and translational motions.

SUMMARY OF THE INVENTION

A hand-held launcher for an aerodynamic toy disk has a handle and a launch housing. The launch housing accepts the disk in a slot therein between sides of the housing. A flat spring in the slot engages a recess in the disk rim. The rim also engages a retractable catch member formed in one or either side of the launch housing slot. To release the disk to be automatically propelled outwardly in spinning flight by the spring, the catch member is retracted from its engagement by the user's moving a bar in the launch housing, to engage and cam the catch member outwardly. The launcher can be readily aimed and tilted for sending the disk on a desired flight direction and curving or straight trajectory.

THE DRAWINGS

FIG. 1 is a perspective view of the launcher of the present invention in use.

FIG. 2 is a developed view of the two sides of the launcher housing and internal parts.

FIGS. 3 and 4 are cross-sectional views of the handle of the launcher of the invention, taken respectively on lines III—III and IV—IV of FIG. 2.

FIG. 5 is an enlarged cross-sectional view of the launch housing, with a disk in place in the slot.

FIG. 6 is a sectional view taken on line VI—VI of FIG. 5.

FIG. 7 is a sectional view of the release bar in a rest position, taken on line VII—VII of FIG. 5.

FIG. 8 is a sectional view taken on line VIII—VIII of FIG. 5.

FIG. 9 is a sectional view, taken on line IX—IX of FIG. 5.

FIG. 10 is a sectional view similar to FIG. 7 but showing an actuation position of the release bar.

FIG. 11 is a sectional view taken on line XI—XI of FIG. 10.

THE PREFERRED EMBODIMENTS

A disk launcher in accordance with the present invention is shown generally at 15 in FIG. 1. The launcher 15 comprises a generally flat, elongate housing portion 16 grippable by the fingers 17 on the hand 18 of a user, the fingers 17 conveniently and comfortably fitting among scallops 19 in a forward side of the handle 16. A launch housing 20 is carried at one end of the handle 16 and comprises two spaced-apart, parallel sides 21, 22. An outside surface of each side may carry one or more raised, radially-extending ridges 23 which may be employed by the user as sighting lines.

A toy disk 24 is received within a slot 25 formed between the opposing sides 21, 22, wherein it engages a spring and a catch tab, discussed below. As shown in FIGS. 5 and 6, and as disclosed and claimed in my U.S. Pat. No. 3,959,915, the disk 24 is circular in shape, having a generally flat center portion 30 surrounded by a peripheral rim 31. The rim 31 is reversely curved from its intersection with the circular portion 30 and extends downwardly to an edge 32 spaced outwardly from the circular inner portion 30. A recess 33 is formed radially through the rim 31 of the disk 23 at one side thereof, as in FIGS. 5 and 6. Upon depression of a plunger 26 extending through the launch housing portion 20, the disk 24 is spun and propelled by the launcher 15 along a desired trajectory 27. An aerodynamic lift is provided over the upper surface of the disk 24, and the spinning of the disk aids in the stable flight of the disk as it is slowed in its arcing path. The flight path and place of landing of the disk 24 can be controlled to some extent by the user by his controlling the attitude of the disk. By tipping the disk 24 so that the left outer edge is lower than the right edge, inside the launch housing 20 in FIG. 1, the fisk will fly to the left of a line perpendicular to the axis of the handle 16. A curving flight to the right may be obtained by raising the left edge higher than the right edge, in the orientation of FIG. 1.

The launcher 15 is conveniently formed in plastic, in two opposite, mating halves including the sides 21, 22, as shown in FIG. 2. The top side 21, in the orientation of FIG. 1, at the left of FIG. 2 and in FIG. 3 is formed with sockets 35 spaced about the periphery thereof. A corresponding plurality of mating pins 36 is formed in the lower or right half 22 of FIG. 2 and in FIG. 4. Each pin 36 is receivable in adhesive, press-fit, or similar permanent engagement with the corresponding socket 35 in the opposite part. Such pins and sockets facilitate assembly of the launcher 15 and increase its strength. Lightening holes 37 can, if desired, be molded into the handle parts 16 for decorative effect. Walls 38, 39 surround the peripheries of the parts 21, 22, respectively, except at the slot area 25 and except for apertures 40 which cooperate to pass the plunger or actuation bar 26.

A generally flat leaf spring 45 is mounted within the launcher 15 at one side of the launching slot 25. The spring 45 preferably comprises a pair of leaves joined together about a ring 46 at an attachment end thereof. The ring 46 is secured over a spring support pin 47 formed in each of the housing sides 21, 22. A rest pin 48 controls the leftward movement of the spring 45, while a load pin 49 to the right side of the rest position of the spring 45 shown in FIG. 2 prevents the spring 45 from rotating about the spring support pin 47. A free end 50 of the spring is engageable with the recess 33 in the rim 31 of the disk 24, as in FIG. 5.

One or both sides 21, 22 of the launch housing portion 20 are formed with a retractable catch member 55 comprising a tab separated from the housing side 21 or 22 on three sides and left attached at a hinge biasing area 56, whereby the catch member 55 is resiliently flexible with respect to the plane of its side of the housing 20. As shown best in FIGS. 6 and 11, each tab 55 carries a catch member 57 thereon which has a sloping surface toward the open slot 25 and a vertical surface or shoulder 58 on the opposite side. The shoulder 58 of the lower side 22 of the housing 20 will engage the lower edge 32 of the rim 31 of the circular disk 24, as in FIG. 6, when the disk 24 is inserted fully into the slot 25. The disk is then retained in the slot 25, tensioned by the abutment surface 58 and the spring 45. The slot 25 will be positioned between 105° and 135°, and preferably at about 120°, from the position of engagement of the rim 31 with the shoulder 58.

As shown in FIGS. 7 and 10, each of the tabs 55 is also formed with a cam surface 60 formed on a free end thereof, opposite the hinge portion 56. The cam surfaces 60 control the planar positions of the tabs 55, and are in turn engaged by release cam surfaces 61 carried on a release bar 62. The bar 62 is guided for longitudinal movement in the housing 20 adjacent the slot 25 by a plurality of guide pins and sockets 63 carried by and between the walls 21, 22 of the housing 20. Two of the guide pins 63 are fixed adjacent the rear wall of the launcher 15, one on either side of the release bar 62. Two others of the pins 63 are carried on the opposite side of the tab 55 therefrom, again with one on either side of the release bar 62. An enlarged head 64 on the inward end of the release bar 62 prevents removal of the bar 62 axially from the housing 20. Vertically-extending ribs 65 space the bar 62 from the walls 21, 22. The plunger 26 is an extension of the release bar 62, extending through the aperture 40 in the walls 38, 39 of the launcher 15.

Depression of the plunger 26 by the thumb of the hand of a user will move the release bar 62 to the right, as shown between FIGS. 7 and 10, causing the cam surfaces 61 on the release bar 62 to move the tabs 55 transversely of the launcher 15 and outwardly of the inside surfaces of the side walls 21, 22, as shown in FIGS. 10 and 11. Because of the spacing of the cam surface 62 opposite the abutment surface 58 from the hinge 56, relatively little force is required to release the disk via the plunger 26, although until such release the disk is held firmly.

In use, a disk 24 is inserted into the slot 25 with the recess 33 therein engaging the free end 50 of the spring 45. The disk 24 is pressed inwardly and into the slot 25 and rotated about the bending spring 45 until the lower edge 32 of the rim 31 is engaged behind the shoulder 58 of one of the tabs 55 in the sides 21, 22 of the launch housing 20. A right-handed user will place the disk 24 with its lower edge engaged behind the catch member 57 of the tab 55 in the lower side 22 of the launcher 15 in the orientation of FIG. 1. A left-handed user would insert the disk 24 in the opposite orientation, with the lower edge 32 being engaged by the capture member 57 on the tab 55 in the opposite wall 21, which, because of the reverse holding of the launcher 15, would then be the lower wall. Since the hinge portions 56 of the tabs 55 are elastic or resilient, the plunger 26 is maintained in its extended position outwardly of the housing 20, whereby the launcher 15 is ready to launch the disk 24.

The launcher 15 is held in the proper hand, with the lower edge 32 of the disk 24 downward. The launcher 15 is held to orient the axes of the flat portion 30 of the disk 24 as desired with the front F in FIG. 5 usually higher than the back B, but with the left side L either higher or lower than the right side R, to send the disk 24 along a desired trajectory 27 with respect to the area in which the disk 24 is to be launched. Because the launcher 15 is a relatively large implement to manipulate, the user is better able to control the orientation of the disk 24 than if he were to use only the elastic impeller of my prior invention of U.S. Pat. No. 3,959,915. Since the spring 45 is always tensioned by bending through a pre-determined arc, the disk 24 is always propelled with the same, limited force, to avoid both breaking the spring 45 and any development of injurious flinging forces. Further, since the user only need depress the plunger 26 to launch the disk 24, the launcher may be used even by small children not having the strength or coordination to bias the spring 45 sufficiently to obtain an enjoyable flight, when they have the assistance of an adult or older child who may load the launcher 15.

Of course, many minor variations may be made in the structure as shown and disclosed without departing from the spirit of the invention herein. For instance, a bell crank could be substituted for the release bar 62, to effect a trigger-type actuation. Variations may be made in the structure of the release tabs 55. Although these and other minor modifications may be suggested by those versed in the art, it should be understood that I wish to embody within the scope of the patent warranted hereon all such modifications as reasonably and properly come within the scope of my contribution to the art.

I claim as my invention:

1. A launcher for propelling toy disks comprising;

a toy disk having a circular center portion and a peripheral rim with a recess extending radially into said rim, said launcher further comprising:

a generally flat, elongate handle manually grippable by a user;

a launch housing attached to the handle and comprising a pair of generally parallel, spaced sides forming a slot therebetween, said slot being open on at least one side of the housing, and the space between the sides being sufficient to pass the disk freely when inserted thereinto;

a generally flat leaf spring carried bewteen the sides of the launch housing, secured at one of its ends to said launch housing, an opposite end thereof extending into said slot of said launch housing and being free and engageable in said recess of the disk rim;

at least one retractable catch member carried on a side of the launch housing in said slot, the catch member being positioned to engage and hold said disk against tension of the spring also engaging said disk; and a release bar means having a portion actuatable from outside the launch housing and handle by a user and including means for selectively retracting said catch member from its engagement with the edge of the disk upon movement of the bar means, whereby when the disk is engaged with the leaf spring and the spring is biased and curved so that the disk is also engaged with the catch means, selective movement of the bar means by a user releases the catch means from the rim of the disk, whereupon the spring propels same from the slot with translational and spinning motions.

2. A launcher as defined in claim 1, wherein the catch means is formed on a tab partially severed from a side of the launch housing, a connection of the tab to the side being flexible and resilient for receiving and releasing the rim of the disk from the catch means thereon.

3. A launcher as defined in claim 2, wherein the tab is elongate and said release bar means selectively engages said tab opposite said connection thereof to the launch housing, whereby to move the tab outwardly of the launch housing to release the disk upon movement of the bar means.

4. A launcher as defined in claim 1, wherein the handle has a symmetric exterior and a retractable catch member is provided on each side of the launch housing, so that the launcher may be used in either hand with the disk reversed with respect thereto for proper launch orientation.

5. A launcher as defined in claim 1, wherein the catch member engages the edge of the rim of the disk at about 105°–135° of arc from the engagement position of the spring with the recess in the disk.

6. A launcher as defined in claim 5, wherein the catch member engages the edge of the rim of the disk at about 120° of arc from the engagement position of the spring with the recess in the disk.

7. A launcher for impelling a toy disk, a toy disk to be impelled having a circular center portion and a notched peripheral rim, the launcher more particularly comprising:

a manually-grippable handle;

a launch housing at one end of said handle and having a spaced pair of sides forming a launching slot therebetween opening out of said launch housing and in which said toy disk is receivable edgewise by insertion;

a flat spring fixed at one of its ends between said sides of said launch housing and having a second, free end normally extending into said launching slot and movable through said slot on an arc parallel to the sides;

a release mechanism comprising, an elongate tab carried on one side of said launch housing, said tab having a retractable catch means extending into said launching slot therefrom for engaging said notched peripheral rim of the toy disk and a release cam thereon spaced from the catch means, and a bar means carried adjacent said launching slot and in selectively engageable relation to the release cam of the tab;

said bar means comprising:

cam actuation means selectively engaging and displacing the release cam of the tab transversly in a shifted position of the bar means and not so displacing the release cam in a rest position thereof, actuation means carried on the bar means for selectively displacing the bar means from said rest position to said shifted position, the actuation means extending from the handle and launch housing into a position engageable by a user's hand grasping the handle, and the actuation means and bar means being biased to said rest position thereof by the tab and release cam, whereby when the disk is engaged with the spring via the notched peripheral rim and a further portion of the rim is captured beneath the catch means of the tab, the disk is released from the launcher along a trajectory, sprining rapidly on an axis transverse to the center portion, upon actuation of the actuation means to move the catch means transversely from the slot.

8. A launcher as defined in claim 7, wherein the bar means and actuation means are formed integrally together.

9. A launcher as defined in claim 8, wherein the bar means is elongate and is shiftable along its axis, and the actuation means extends axially thereof and out of the housing.

10. A launcher as defined in claim 7, wherein:

a second tab is formed identically with the first-noted tab on an opposite side of the launch housing from said first capture tab; and wherein the bar means carries a cooperating cam actuation means engageable with the cam means on the second capture tab; and wherein the handle is symmetric about a plane parallel to the sides of the launch housing, whereby the launcher may be used in either of a user's hand with the reversed curve in the disk rim facing upwardly for launch.

11. A launcher as defined in claim 7, wherein the bar means is guided for longitudinal movement among four pins extending transversely across the interior of the launcher housing, two of said pins being on either side of the bar means and on either side of the tab.

12. A launcher as defined in claim 7, wherein the flat spring comprises a leaf spring having at least two leaves each contacting another along its length.

13. A launcher for an aerodynamic disk toy, a disk toy to be launched having a peripherally recessed circumferential edge comprising, a body member sized to be held in the hand of a user and having a finger actuated trigger extending outwardly of said body for selective engagement by the user, and including a launch housing forming a slot in which a disk toy is inserted, pre-loadable biasing means comprising a leaf spring forming recess engaging means at one end disposed in said slot for entering the peripherally recessed edge of the disk toy and having its opposite end connected to said launch housing whereby energy can be stored on the biasing means when the disk toy is inserted into said slot, and cocking and releasing means actuated by said trigger comprising a retractable catch member carried on a side of said launch housing and having means to engage and hold an edge of the disk toy when tensioned by said spring and cooperable with said biasing means to temporarily lock said biasing means and the disk toy in pre-loaded assembly and selectively actuable to trigger-release the disk toy for flight.

* * * * *